US005611094A

United States Patent [19]

D'Entremont

[11] Patent Number: 5,611,094

[45] Date of Patent: Mar. 18, 1997

[54] WALL STOP FOR A BED

[75] Inventor: Everett A. D'Entremont, Burlington, Canada

[73] Assignee: M.C. Healthcare Products Inc., Beamsville, Canada

[21] Appl. No.: 519,004

[22] Filed: Aug. 24, 1995

[51] Int. Cl.[6] ..... A47C 21/00

[52] U.S. Cl. ..... 5/424; 5/663; 5/658; 248/345.1

[58] Field of Search ..... 5/663, 658, 600, 5/624; 248/345.1

[56] References Cited

U.S. PATENT DOCUMENTS

| | | | |
|---|---|---|---|
| 1,017,153 | 2/1912 | Kampe | 5/663 |
| 1,212,514 | 1/1917 | Lathrop et al. | 5/663 |
| 1,445,726 | 2/1923 | Soros | 248/345.1 |
| 4,016,613 | 4/1977 | Benoit et al. | 5/663 |
| 4,391,007 | 7/1983 | Mitchell | 5/600 |

*Primary Examiner*—Alexander Grosz
*Attorney, Agent, or Firm*—Rogers & Scott

[57] ABSTRACT

The invention provides a wall stop or spacer which is mounted on the hospital bed and impinges on the skirting of the wall near the floor should the bed be pushed towards the wall with resulting impact. Also, because the engagement is usually at right angles to the wall, the spacer has a width greater than the distance between the studs in the wall so that the load will be distributed across the studs. Further, because the impact is on the skirting, the impact takes place at one of the strongest pans of the wall where the wall plate and studs meet and the skirting passes over these pans to further reinforce the structure. The wall stop can be placed in a deployed position for engagement with the skirting or manually moved into a stored position under the bed to permit an attendant to walk behind the bed when the bed is moved from room to room.

9 Claims, 2 Drawing Sheets

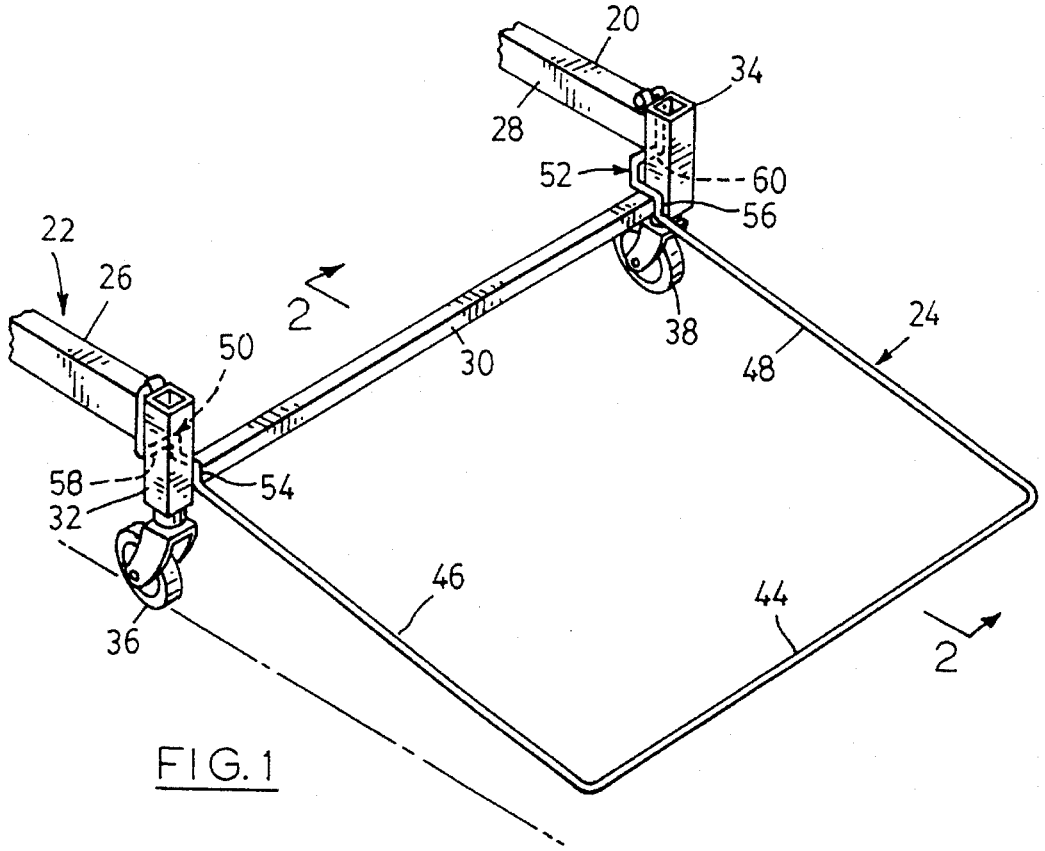
FIG. 1
FIG. 2
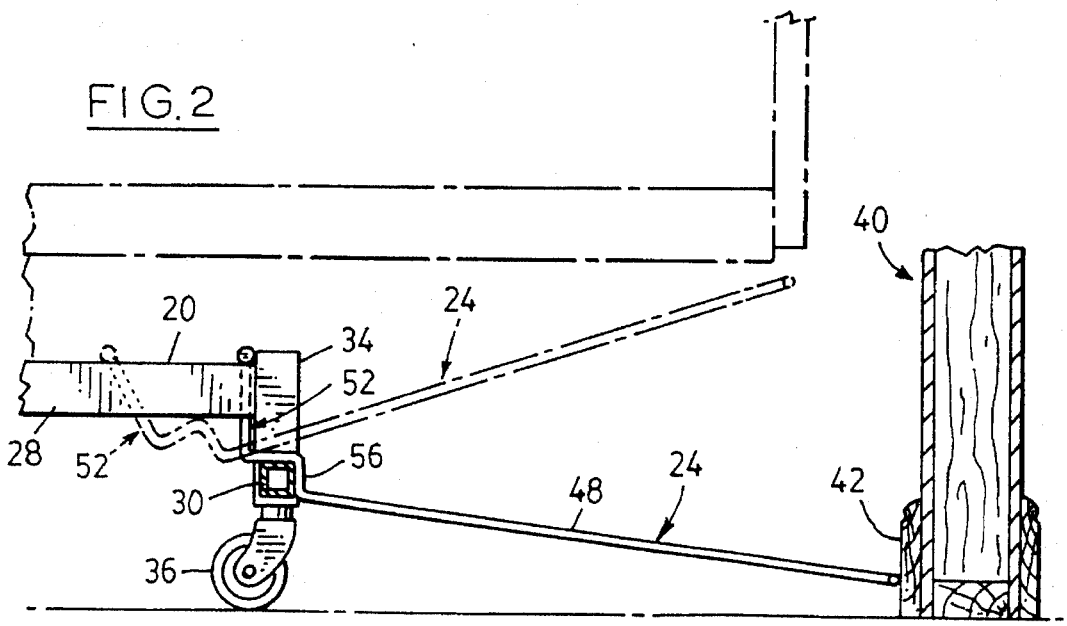

WALL STOP FOR A BED

FIELD OF THE INVENTION

This invention relates to a wall stop or spacer for use with institutional beds such as hospital beds to maintain the position of the bed relative to a wall and to absorb impact should the bed be pushed into engagement with the wall, the stop being designed to minimize damage to the wall.

BACKGROUND OF THE INVENTION

Institutional beds are mounted on casters so that attendants can move the bed readily both to service the bedroom and also to move the beds from room to room. The beds are quite bulky and it is not uncommon when placing the bed with the head adjacent the wall that the attendant pushes the bed too close to the wall resulting in impact and possible damage to the wall. Because the beds are metal and quite angular, the impact can cause structural damage to plaster walls, particularly when the impact takes place midway between studs supporting the plaster wall. The wall can become severely damaged over a period of time and major overhaul then becomes necessary.

One of the difficulties has been that the point of impact of the bed is quite high on the wall but varies as the bed is raised and lowered. Also, some elevating mechanisms used on such beds cause the upper platform to move longitudinally as it is elevated. Consequently, it is necessary to maintain space between this platform and the wall so that the platform is not driven into the wall when the bed is elevated.

SUMMARY OF THE INVENTION

The present invention is intended to provide a wall stop or spacer which is mounted on the hospital bed and impinges on the skirting of the wall near the floor should the bed be pushed towards the wall with resulting impact. Also, because the engagement is usually at right angles to the wall, the spacer has a width greater than the distance between the studs in the wall so that the load will be distributed across the studs. Further, because the impact is on the skirting, the impact takes place at one of the strongest parts of the wall where the wall plate and studs meet and the skirting passes over these pans to further reinforce the structure.

The wall stop according to the invention can be placed in a deployed position for engagement with the skirting or manually moved into a stored position under the bed to permit an attendant to walk behind the bed when the bed is moved from room to room.

BRIEF DESCRIPTION OF THE DRAWINGS

FIG. 1 is a perspective view of a wall stop or spacer according to a preferred embodiment of the invention and shown assembled on a lower frame of an elevating bed, (only a portion of the bed being shown) and the spacer being in a deployed position ready for use;

FIG. 2 is a sectional side view on line 2—2 of FIG. 1 of the spacer showing engagement against a baseboard of a wall, and also showing in ghost outline the spacer as it is being moved into a stored position;

DETAILED DESCRIPTION OF THE PREFERRED EMBODIMENT

Figure 3:
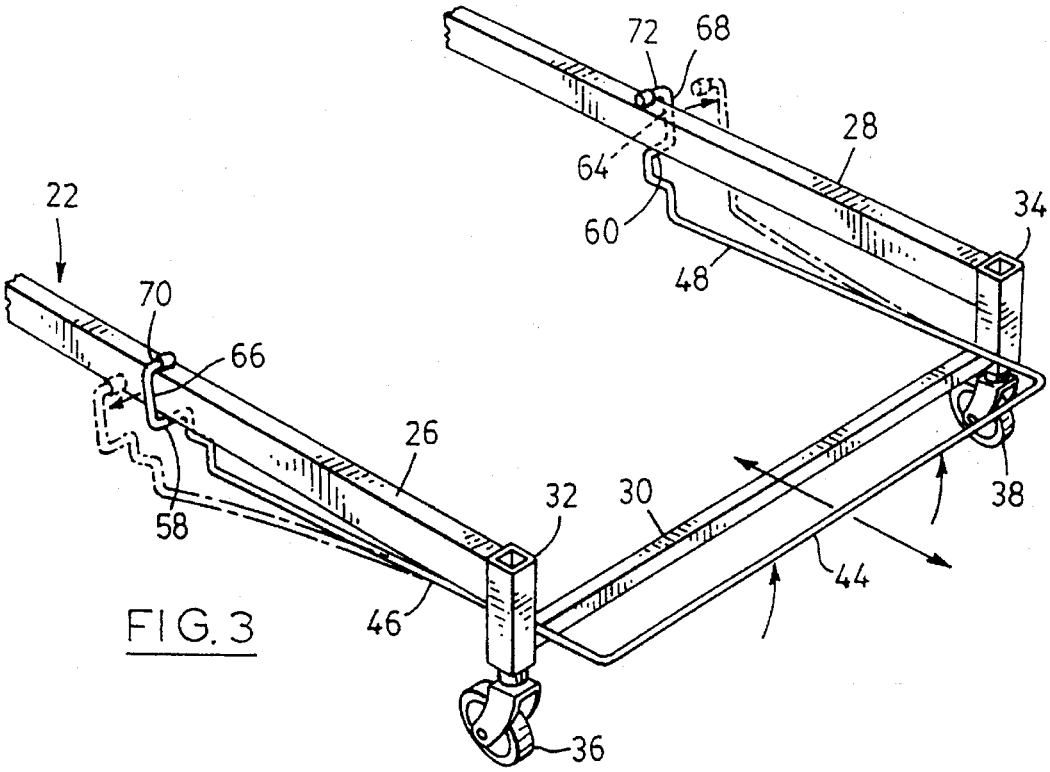
FIG. 3 is a view of the spacer on the bed in a stored position and showing in ghost outline how the spacer is assembled on the bed.

Reference is made first to FIG. 1 which illustrates part of a lower frame 20 of a bed indicated generally by the numeral 22 and to which is attached a wall stop or spacer 24 according to a preferred embodiment of the invention. The bed is exemplary of many so called "institutional" beds which are typically used in hospitals and long term care facilities. Commonly the bed will include a pair of side members 26, 28 spaced apart by a transverse member 30 which, together with the side members meets corner uprights 32, 34 supported by casters 36, 38 (although not shown, there will be similar parts at the opposite end of the bed).

The spacer 24 engages both the transverse member 30 and the side members 26, 28 to permit the spacer to prevent the bed from meeting a wall and also, to permit the spacer to be stored under the bed. These aspects of the invention will be better understood with reference to FIGS. 1 and 2 taken in combination.

As seen in FIG. 2, the purpose of the spacer 24 is to prevent the bed from being pushed into a wall shown generally in section and referenced by the numeral 40. A wall skirting 42 (which is exemplary of many forms of skirting) covers the strongest part of the wall and acts as a surface for engagement by the spacer 24. As can be seen in FIGS. 1 and 2, the spacer consists of a straight transverse piece 44 extending from ends of side pieces 46, 48 which terminate at ends remote from the transverse piece in respective end structures designated generally by the numerals 50, 52.

The end structures include two elements to transmit load from the transverse piece 44 to the frame 20 of the bed. These are respective load transfer elements 54, 56 which extend upwardly from ends of the respective side pieces 46, 48. The angle between these parts is better seen in FIG. 2 where the load transfer element 56 can be seen extending vertically and the side piece 48 extends downwardly towards the floor to meet the skirting 42 just above the floor. Consequently, should the bed be driven into the wall, the spacer 24 will stop the bed and the reactive force will be applied by the spacer to the transverse member 30. Because the spacer is angled downwardly to the skirting, there will be a tendency for the load transfer elements 54, 56 to slide upwardly off the transverse member 30. This is resisted by respective stabilizers 58, 60 which form part of the respective end structures and extend outwardly under the side members 26, 28. The stabilizers also act to prevent rotation of the stabilizer about the end structures thereby limiting the downward deflection of the stabilizer when it engages the skirting. However should the force be such that the stabilizer is deflected, then of course it can go no further than meet the floor at which point it will be totally resistant to further movement.

Beds of this type are commonly moved regularly. This is done both to service the beds and the surrounding areas in the room, and also to move patients between rooms. The casters permit this movement and a person wheeling the bed would find the spacer to be a hazard as that person walks behind the bed. To facilitate this activity, the spacer can be stored under the bed.

Reference is now made to FIGS. 2 and 3 with initial reference to FIG. 2 where it will be seen in ghost outline that the spacer has been lifted from the full-line position. By doing this, the load transfer elements 54 (FIG. 1) and 56 are moved out of engagement with the transverse member 30 so that the spacer can be moved along the length of the bed. However to avoid complete disengagement, the end structures 50, 52 (FIG. 1) are shaped to maintain engagement on the side members 26, 28. As better seen in FIG. 3, the end structures include generally U-shaped portions 62, 64 having respective central parts 66, 68 extending vertically with the U-shaped portions including the respective stabilizers 58, 60 which have been described. The U-shaped portions are completed by hangers 70, 72 in engagement with upper surfaces of the side members 26, 28.

The U-shaped portions 62, 64 are proportioned to be a loose sliding fit on the side members 26, 28 of the bed. Consequently, it will be seen in FIG. 2 in ghost outline that the spacer can slide along the bed into the position shown in FIG. 3 where the transverse piece 44 is adjacent the transverse member. The spacer has now been moved from the deployed position shown in FIG. 1 to a stored position seen in FIG. 3.

It should be noted that the U-shaped portions 62, 64 engage about the respective outer surfaces of the side members 26, 28 whereas the connections between the load transfer elements 54, 56 lie inside the uprights 32, 34. As a result, when in the deployed position shown in FIG. 1, the end structures are located to prevent movement longitudinally of member 30.

FIG. 3 also illustrates the assembly of the spacer. There is a certain amount of flexibility in the spacer which is preferably made of plated round steel rod. The spacer is engaged in the position shown in ghost outline where the end structures can be deflected sufficiently to permit engagement on the side members of the bed.

Although the spacer has been shown to be made from a single piece of round bar, it can of course be fabricated in many forms consistent with the invention. Also, the end structures can be changed depending upon the style of the bed. TO demonstrate this, a different style of bed is shown in FIG. 4 where parts having similar functions to those already described carry the same numeral increased by 100.

The side members 126, 128 of bed 122 cooperate with uprights 132, 134 which are attached to a transverse member 130. This structure can be contrasted with that shown in FIG. 1 to demonstrate that in FIG. 1 the transverse member 30 is below the side members 26, 28 whereas in FIG. 4 the corresponding relationships are reversed. However, the spacer 124 is very similar to spacer 24 shown in FIG. 1 in that the spacer 124 includes a transverse piece 144, side pieces 146, 148 and end structures 150, 152. These end structures include load transfer elements 154, 156 and stabilizers 158, 160 which differ from the stabilizers 58, 60 (FIG. 1) in that they operate under the side members 126, 128 to prevent upward movement of the spacer on impact with a skirting. Nevertheless the stabilizers 158, 160 form parts of a U-shaped portion 162, 164 which include hangers 170, 172 to perform the same functions as the hangers 70, 72 shown in FIG. 3.

Figure 4:
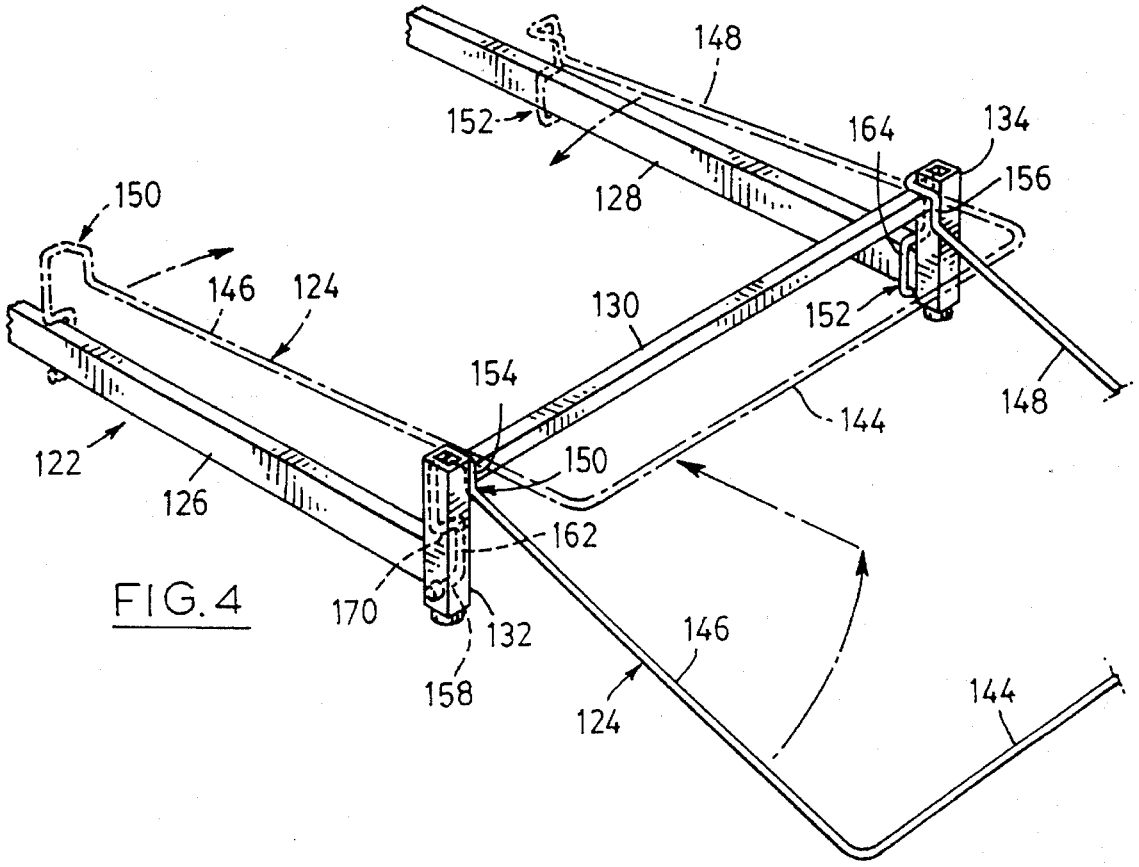
FIG. 4 is a view similar to FIG. 1 and showing an alternative embodiment of bed and spacer with the stored position of the spacer being shown in ghost outline.

As a result of the structure of the spacer 124, the spacer can be stored by elevating the transverse piece 144 and sliding the spacer along the bed frame into the ghost outline position shown in FIG. 4.

It will be evident to a person skilled in the art that these and other embodiments of the invention are within the scope of the invention as described and claimed.

I claim:

1. A spacer for use with an institutional bed to locate the bed relative to a wall, the bed having a pair of horizontal side members, transverse members extending between the side members adjacent ends of the side members, the spacer comprising:

a transverse piece having ends;

a pair of parallel side pieces extending from the respective ends of the transverse piece;

a pair of end structures attached one to each of the side pieces remote from the transverse piece, each of the end structures having an upright load transfer element attached one to each of the side pieces for engagement with the transverse member of the bed, and a stabilizer spaced from and coupled to the load transfer element for engagement with the respective ones of the side members of the bed;

the spacer being proportioned to hold the bed away from the wall such that any loading resulting from engaging the wall will be resisted by the load transfer elements and the stabilizers; and each of the end structures having a U-shaped portion including the stabilizer, the U-shaped portion having a central part extending vertically with the stabilizer attached to one end of the central part, and a guide attached to the other end of the central part, the U-shaped portions being proportioned to fit loosely on the side members whereby the spacer can be stored by lifting the transverse end piece to disengage the load transfer elements and sliding the U-shaped portions along the side members until the transverse piece is adjacent the transverse member of the bed.

2. A spacer as claimed in claim 1 in which the side pieces are normally inclined downwardly in use.

3. A spacer is claimed in claim 2 in which the transverse piece is proportioned so that in use the side pieces lie just inside the side members of the bed.

4. A spacer as claimed in claim 1 in which the spacer is formed integrally from round steel rod.

5. A spacer as claimed in claim 1 in which the transverse piece is straight.

6. In an institutional bed of the type having a pair of horizontal side members, transverse members extending between the side members adjacent ends of the side members, and corner uprights attached to both the transverse members and to the side members, the improvement comprising:

a spacer for locating the bed relative to a wall, the spacer being moveable between deployed and stored positions and comprising:

a transverse piece having ends;

a pair of parallel side pieces extending from the respective ends of the transverse piece and being spaced to fit just inside a pair of the uprights at an end of the bed;

a pair of end structures attached one to each of the side pieces remote from the transverse piece, each of the end structures having an upright load transfer element attached one to each of the side pieces for engagement with the transverse member adjacent an upright with the spacer in the deployed position, and a stabilizer spaced from and coupled to the load transfer element and engaged with the respective ones of the side members of the bed;

the spacer being proportioned to hold the bed away from the wall such that any loading resulting from engaging the wall will be resisted by the load transfer elements and the stabilizers; and each of the end structures having a U-shaped portion including the stabilizer, the U-shaped portion having a central part extending vertically with the stabilizer attached to one end of the central part, and a guide attached to the other end of the central part, the U-shaped portions being proportioned to fit loosely on the side members whereby the spacer can be moved from the deployed to the stored position by lifting the transverse end piece to disengage the load transfer elements and sliding the U-shaped portions along the side members until the transverse piece is adjacent the transverse member of the bed.

7. In an institutional bed as claimed in claim 6, the further improvement in which the side pieces are normally inclined downwardly in use in the deployed position.

8. A bed for institutional use, the bed comprising:

a pair of horizontal side members;

a pair of transverse members extending between the side members adjacent respective ends of the side members;

four corner uprights attached to both the transverse members and to the side members;

a spacer for locating the bed relative to a wall, the spacer being moveable between deployed and stored positions and including a transverse piece having ends; a pair of parallel side pieces extending from the respective ends of the transverse piece and being spaced to fit just inside a pair of the uprights at an end of the bed; a pair of end structures attached one to each of the side pieces remote from the transverse piece, each of the end structures having an upright load transfer element attached one to each of the side pieces for engagement with the transverse member adjacent an upright with the spacer in the deployed position, and a stabilizer spaced from and coupled to the load transfer element and engaged with the respective ones of the side members of the bed; and the spacer being proportioned to hold the bed away from the wall such that any loading resulting from engaging the wall will be resisted by the load transfer elements and the stabilizers; and each of the end structures having a U-shaped portion including the stabilizer, the U-shaped portion having a central part extending vertically with the stabilizer attached to one end of the central part, and a guide attached to the other end of the central part, the U-shaped portions being proportioned to fit loosely on the side members whereby the spacer can be stored by lifting the transverse end piece to disengage the load transfer elements and sliding the U-shaped portions along the side members until the transverse piece is adjacent the transverse member of the bed.

9. A bed as claimed in claim 8 in which the side pieces are so inclined downwardly in the deployed position.

* * * * *